US005743864A

United States Patent [19]

Baldwin, II

[11] Patent Number: 5,743,864

[45] Date of Patent: Apr. 28, 1998

[54] METHOD AND APPARATUS FOR PERFORMING CARDIO-PULMONARY RESUSCITATION WITH ACTIVE RESHAPING OF CHEST

[75] Inventor: R. Mitchell Baldwin, II, Grand Rapids, Mich.

[73] Assignee: Michigan Instruments, Inc., Grand Rapids, Mich.

[21] Appl. No.: 496,732

[22] Filed: Jun. 29, 1995

[51] Int. Cl.[6] ..... A61H 31/00

[52] U.S. Cl. ..... 601/41; 601/1; 601/44; 601/134

[58] Field of Search ..... 601/1, 41, 42, 601/43, 44, 134, 135; 607/108, 114; 602/13; 128/DIG. 20

[56] References Cited

U.S. PATENT DOCUMENTS

| | | | |
|---|---|---|---|
| 1,629,626 | 5/1927 | Jirasek | 607/108 |
| 2,071,215 | 2/1937 | Petersen | 601/41 |
| 3,364,924 | 1/1968 | Barkalow . | |
| 3,364,925 | 1/1968 | Barkalow . | |
| 3,425,409 | 2/1969 | Isaacson et al. | 601/41 |
| 3,461,861 | 8/1969 | Barkalow et al. . | |
| 3,610,233 | 10/1971 | Barkalow . | |
| 3,985,126 | 10/1976 | Barkalow . | |
| 4,004,579 | 1/1977 | Dedo | 601/41 |
| 4,198,963 | 4/1980 | Barkalow et al. . | |
| 4,273,114 | 6/1981 | Barkalow et al. . | |
| 4,294,244 | 10/1981 | Pasternack | 807/108 |
| 4,326,507 | 4/1982 | Barkalow . | |
| 4,361,140 | 11/1982 | Barkalow . | |
| 4,570,615 | 2/1986 | Barkalow . | |
| 4,928,674 | 5/1990 | Halperin et al. . | |
| 5,056,505 | 10/1991 | Warwick et al. . | |
| 5,407,421 | 4/1995 | Goldsmith | 607/114 |
| 5,490,820 | 2/1996 | Schuck et al. | 601/41 |

FOREIGN PATENT DOCUMENTS

| | | | |
|---|---|---|---|
| 145985 | 5/1936 | Austria | 601/41 |
| 509773 A | 10/1992 | European Pat. Off. . | |
| 2140694 | 12/1984 | United Kingdom | 601/41 |
| 9426229 | 11/1994 | WIPO | 601/41 |

OTHER PUBLICATIONS

Henry R. Halperin, M.D. et al., "a Preliminary Study of Cardiopulmonary Resuscitation by Circumferential Compression of the Chest with Use of aPneumatic Vest", *The New England Jounal of Medicine*, Sep. 9, 1993, 762.

*Primary Examiner*—Jeanne M. Clark

*Attorney, Agent, or Firm*—Van Dyke, Gardner, Linn & Burkhart, LLP

[57] ABSTRACT

An apparatus and method for performing cardio-plumonary resuscitation with active reshaping of a patient's chest are disclosed. A piston positioned near a patient's sternum is intermittently activated to produce cycles of direct compression on the patient's heart while an annular collar is simultaneously placed securely around a patient's thoracic cavity to limit the circumferential changes in the thoracic cavity. The combination of the annular collar and piston combine to direct blood flow both by direct cardiac compression/decompression and by varying the intrathoracic cavity pressure. The annular collar can be formed by a single non-extensible membrane or by a non-extensible outer membrane and an extensible inner membrane with a bladder therebetween filled with a substantially non-compressible fluid. The collar may be attached to the piston and the piston actively driven away from the patient during decompression resulting in an active reshaping of the chest to lower central venous pressure and thereby induce a rapid return of blood to the thoracic cavity.

14 Claims, 4 Drawing Sheets

METHOD AND APPARATUS FOR PERFORMING CARDIO-PULMONARY RESUSCITATION WITH ACTIVE RESHAPING OF CHEST

BACKGROUND OF THE INVENTION

This invention relates generally to a method and apparatus for performing cardio-pulmonary resuscitation and, more particularly, to a technique, which is implemented utilizing a mechanical resuscitator.

Cardio-pulmonary resuscitation, or CPR, through the use of chest compressions applied to the sternum of a supine patient, was based upon a theory that the positioning of the heart between the sternum and spinal column causes a massaging of the heart when a compression force is applied between the sternum and spine. A mechanical device for applying the chest compressions was developed by the assignee of the present application and is disclosed in U.S. Pat. No. 3,610,233 entitled MASSAGE APPARATUS.

Medical research has refined the original model of the pumping mechanism during CPR, at least as it pertains to certain patients. Subsequent theories hold that, rather than direct cardiac compressions, the blood flow during CPR is induced by an increase in intrathoracic pressure resulting from the chest compressions applied to the sternum. Both theories of induced blood flow find support in the scientific literature.

An adjunct to mechanical CPR is active expansion of the thoracic cavity between chest compressions. This technique, which is known as active compression and decompression, or ACD, assists in the venous blood return to the cardiac chambers for more efficient pumping during the subsequent compression cycle. In this manner, ACD is believed to be more effective than chest compressions alone.

SUMMARY OF THE INVENTION

The present invention is based upon an understanding that the placement of the internal organs in some patients translates chest compressions into direct cardiac compression, because the heart lies in an opportune location within the chest, whereas, for other patients, it is the increase in intrathoracic pressure which induces blood flow during mechanical CPR. A CPR technique according to the invention stimulates both direct cardiac compression and a thoracic pump mechanism in order to induce blood flow during CPR irrespective of the physiology of the patient.

A method of performing cardio-pulmonary resuscitation, according to one aspect of the invention, includes applying a compression force between the patient's sternum and spine while restraining the circumference of the patient's thoracic cavity. The compression force applies direct cardiac compression to the patient. The restraining of the circumference of the patient's thoracic cavity translates the compression force into an increase in intrathoracic cavity pressure that is greater than that resulting from the compression force alone. This increase is brought about because restraining the circumference of the patient's thoracic cavity translates the compression force into a greater reduction in the volume of the cavity. The greater reduction in volume results in a commensurate increase in intrathoracic cavity pressure.

According to another aspect of the invention, the patient's thoracic cavity is actively reshaped after each application of sternum compression. This active reshaping of the thoracic cavity results in a forced decrease in the intrathoracic cavity pressure in order to induce the return of venous blood flow to the heart. In this manner, the benefits of active compression/decompression CPR are realized by the invention.

Advantageously, the invention can be carried out with a mechanical resuscitator by applying a non-extensible annular collar around the patient's chest in order to restrain the circumference of the patient's thoracic cavity while the piston of the mechanical resuscitator applies chest compressions. In one embodiment, the annular collar is a strap surrounding the patient's chest. In another embodiment, the collar is configured as a two-membrane device with a non-compressible fluid filling the cavity defined between the membranes. In this manner, the compression force supplied during chest compression forces the fluid from a central cavity portion more evenly between the membranes, which causes a further contraction in the volume of the intrathoracic cavity in order to further increase intrathoracic pressure to enhance thoracic pumping.

The active reshaping of the patient's thoracic cavity between chest compressions may be accomplished by joining the collar to the piston of the mechanical resuscitator and actively driving the piston in both the compression direction and the decompression direction. The actively driven return stroke applies an anterior force on the collar, which compresses the sides of the chest toward each other because of the non-extensible nature of the collar. This serves to actively reshape the chest.

These and other objects, advantages, and features of this invention will become apparent upon review of the following specification in conjunction with the drawings.

DESCRIPTION OF THE PREFERRED EMBODIMENT

Figure 1:
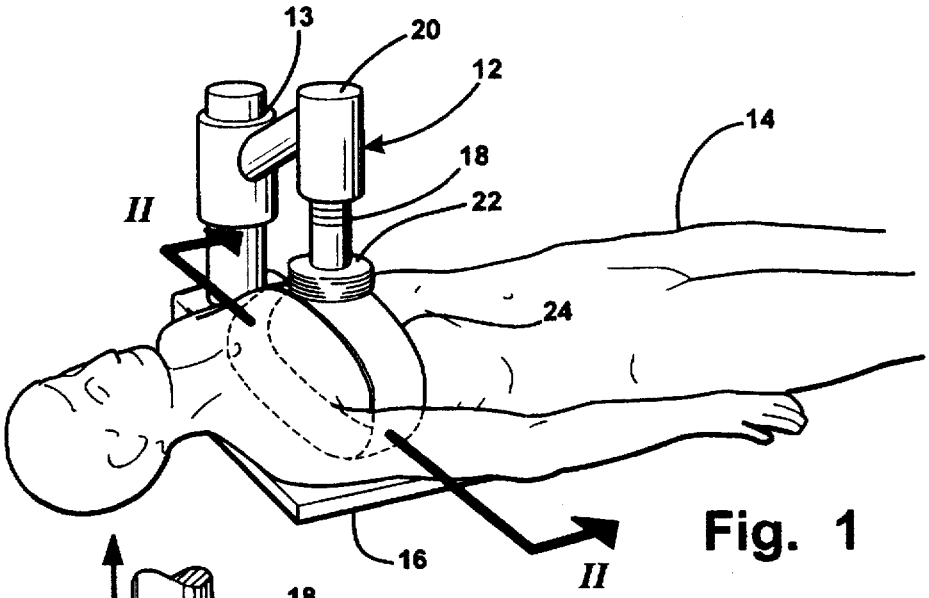
FIG. 1 is a perspective view of a cardio-thoracic pump resuscitator in use with a patient.

Referring now specifically to the drawings, and the illustrative embodiments depicted therein, a cardio-thoracic pump resuscitator 12 is illustrated connected with a patient 14 (FIG. 1). Resuscitator 12 includes a mechanical actuator 13 having a lower support plate 16 in order to support the patient in a supine position and a piston 18, including an actuating cylinder 20 and a massage pad 22, which conforms to the contour of the sternum of patient 14.

Figure 3:
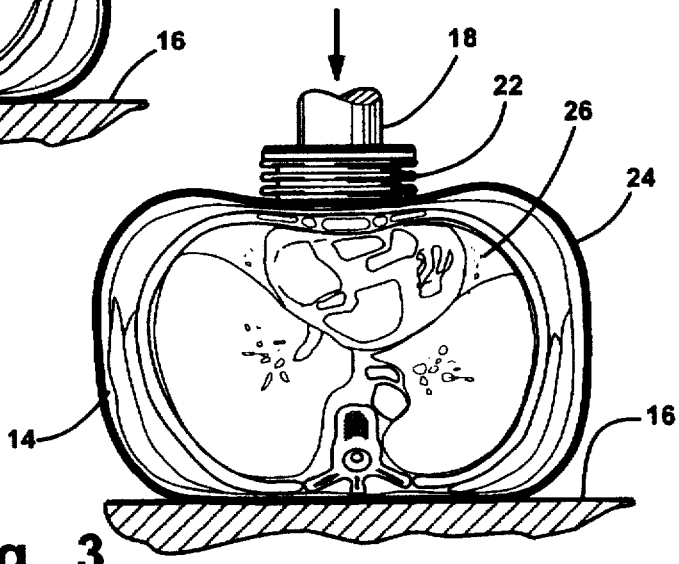
FIG. 3 is the same view as FIG. 2 illustrating the compression portion of a CPR compression/decompression cycle.

Resuscitator 12 additionally includes a non-extensible annular collar 24, which surrounds, and conforms to, the contour of the chest of patient 14 during the compression portion of a CPR compression/decompression cycle. The purpose of annular collar 24 is to restrain the circumference of the thoracic cavity of patient 14 during chest compressions. In this manner, a chest compression resulting from a downward movement of piston 18, as illustrated in FIG. 3, will not result in a significant outward displacement of the sides of the patient's chest as would occur without the presence of collar 24. Because the circumference of the patient's chest is constrained, as illustrated in FIG. 3, the volume of thoracic cavity 26 of the patient will be reduced to a smaller volume than would occur if the sides of the chest cavity were allowed to expand. The result is an increase in the intrathoracic pressure of thoracic cavity 26.

Figure 4:
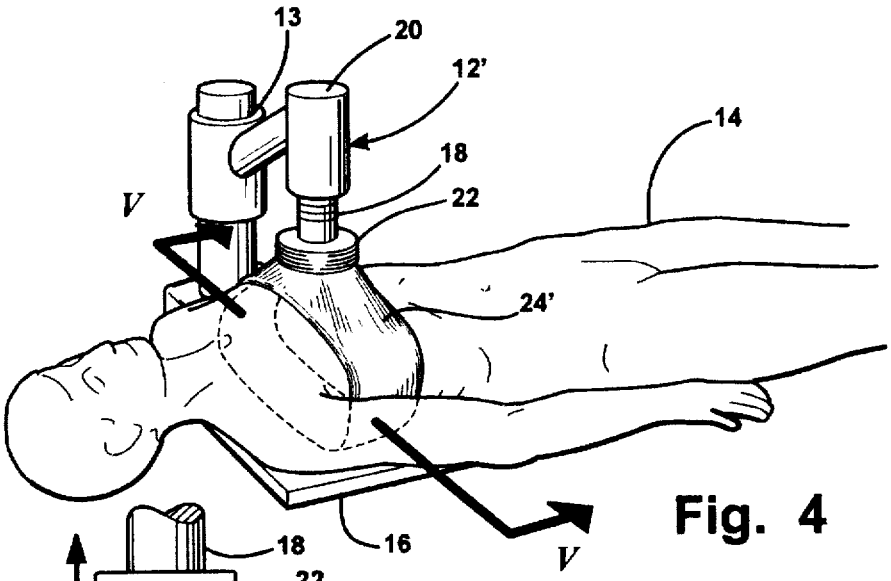
FIG. 4 is the same view as FIG. 1 of an alternative embodiment of the invention.
Figure 5:
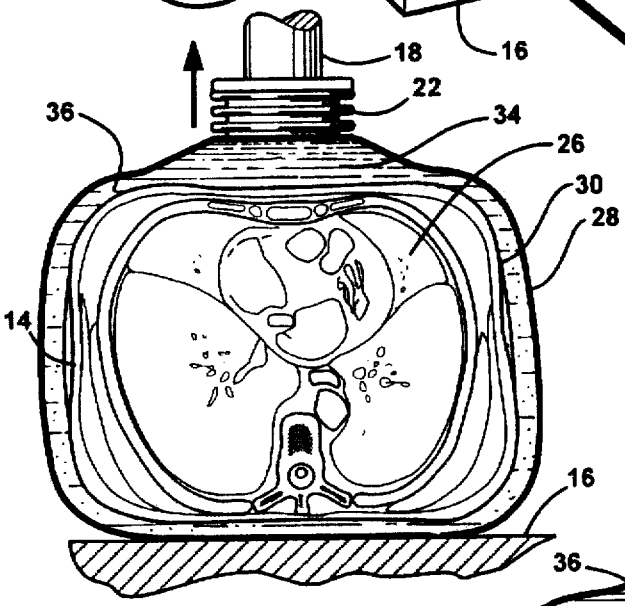
FIG. 5 is a sectional view taken along the lines V—V in FIG. 4 illustrating the decompression portion of a CPR compression/decompression cycle.
Figure 6:
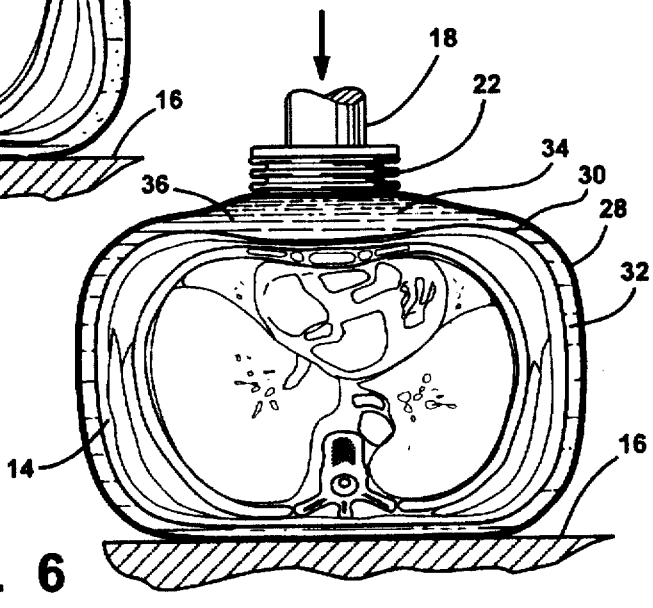
FIG. 6 is the same view as FIG. 5 illustrating the compression portion of a CPR compression/decompression cycle.

An alternative resuscitator 12' is provided, which includes a collar 24' that is made up of an outer membrane 28 and an inner membrane 30 defining therebetween a cavity 32 (FIGS. 4–6). Cavity 32 extends most or all of the way around the chest of patient 14 and includes an enlarged reservoir portion 34 immediately sub-adjacent massage pad 22. Cavity 32 is filled with a non-compressible liquid, such as hydraulic fluid, water, or other fluid selected to have the desired viscosity, as would be within the ability of the skilled artisan to select. Outer membrane 28 is substantially non-extensible. In this manner, a chest compression performed by the downward movement of piston 18 causes a direct cardiac compression of patient 14 because the downward force exerted by massage pad 22 is transmitted through non-compressible fluid 36 to the patient's sternum, as illustrated in FIG. 6. Concurrently, fluid 36 is partially forced from reservoir 34 to the portion of cavity 32 surrounding the patient's chest. Because outer membrane 28 is non-extensible, the movement of the non-compressible fluid 36 reduces the diameter of inner membrane 30 and thereby directly compresses the patient's chest from all directions. This directly compresses the volume of the thoracic cavity of the patient and results in a further increase in intrathoracic pressure, thereby enhancing thoracic pump CPR. During the return stroke of piston 18, fluid 36 returns to reservoir 34 because of the lowering of the pressure in cavity 32 resulting from retraction of the piston.

Resuscitators 12 and 12' increase blood flow during mechanical CPR because both the direct cardiac compression and thoracic pump CPR techniques are utilized. Accordingly, if the patient's heart is positioned in the thoracic cavity in a manner that would benefit from direct cardiac compression, that benefit is realized. If the patient's heart is positioned where it will not be subject to direct cardiac compression, then the enhanced thoracic pump CPR provided by resuscitators 12 and 12' will promote the blood flow.

Figure 7:
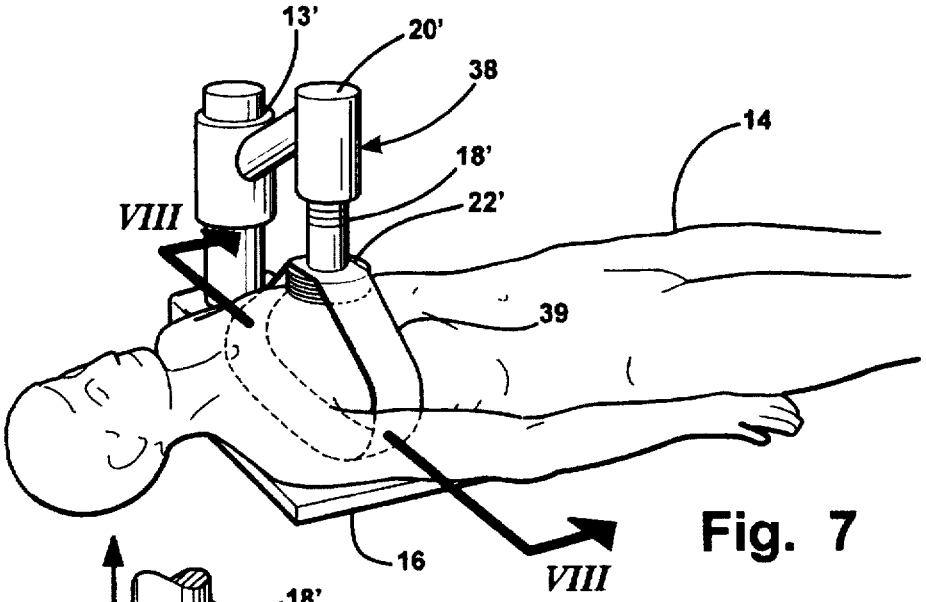
FIG. 7 is the same view as FIG. 1 illustrating another aspect of the invention.
Figure 8:
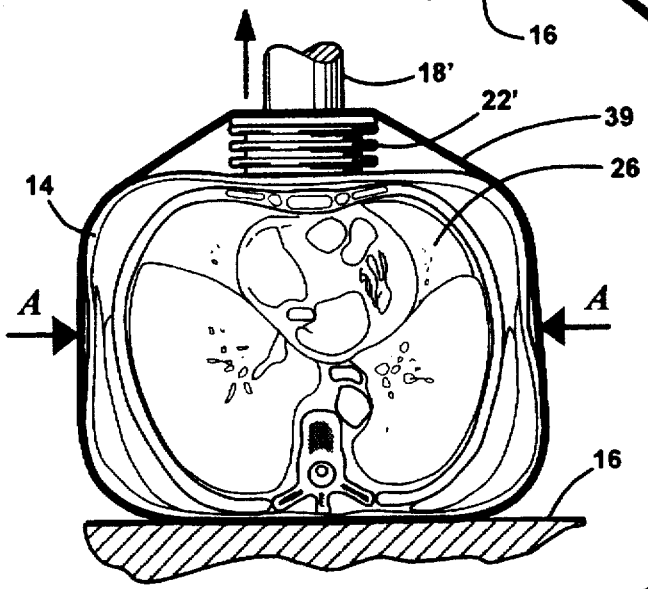
FIG. 8 is a sectional view taken along the lines VIII—VII in FIG. 7 illustrating the decompression portion of a CPR compression/decompression cycle.
Figure 9:
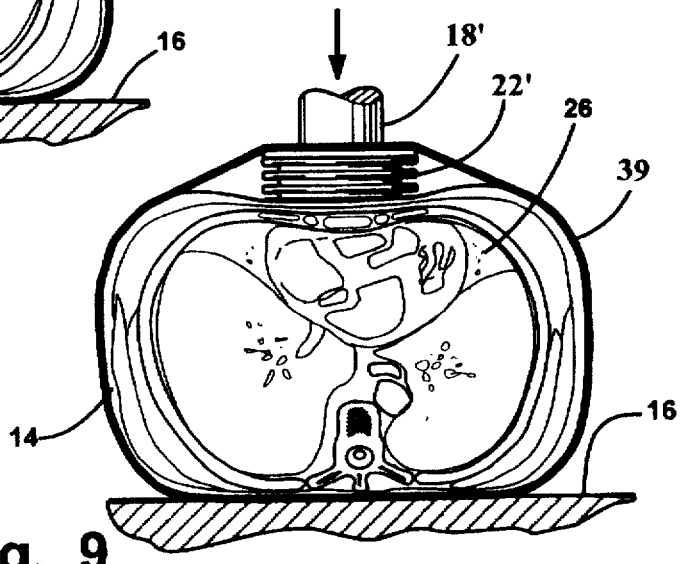
FIG. 9 is the same view as FIG. 8 illustrating the compression portion of a CPR compression/decompression cycle.

A mechanical resuscitator 38 that is capable of active reshaping of the chest is shown in FIGS. 7–9. Resuscitator 38 includes a cylinder 20' having a piston 18' that is actively driven in both the upward direction as well as the downward direction. Resuscitator 38 further includes a collar 39 that extends over the upper portion of massage pad 22. Collar 39 is non-extensible and may closely surround the sides and back of the patient's chest in order to restrain the circumference of the patient's thoracic cavity when the piston 18 is driven toward the support plate 16. Alternatively, collar 39 may be loosely fitting around the patient's chest. The joining of collar 39 with the upper portion of massage pad 22 provides a rigid interconnection during the upward stroke of piston 18'. Because collar 39 is not extensible, the upward movement of piston 18' during the return stroke translates into an inward force exerted against the sides of the patient's chest, as illustrated by arrows A' in FIG. 8. This inward force provides an active reshaping of the chest in between chest compressions. This active reshaping of the chest lowers the intrathoracic cavity pressure at a more rapid rate than would occur by the natural compliance of the chest alone. The result is that venous blood flow returns more rapidly to the cardiac chambers in preparation for the next chest compression cycle.

Figure 10:
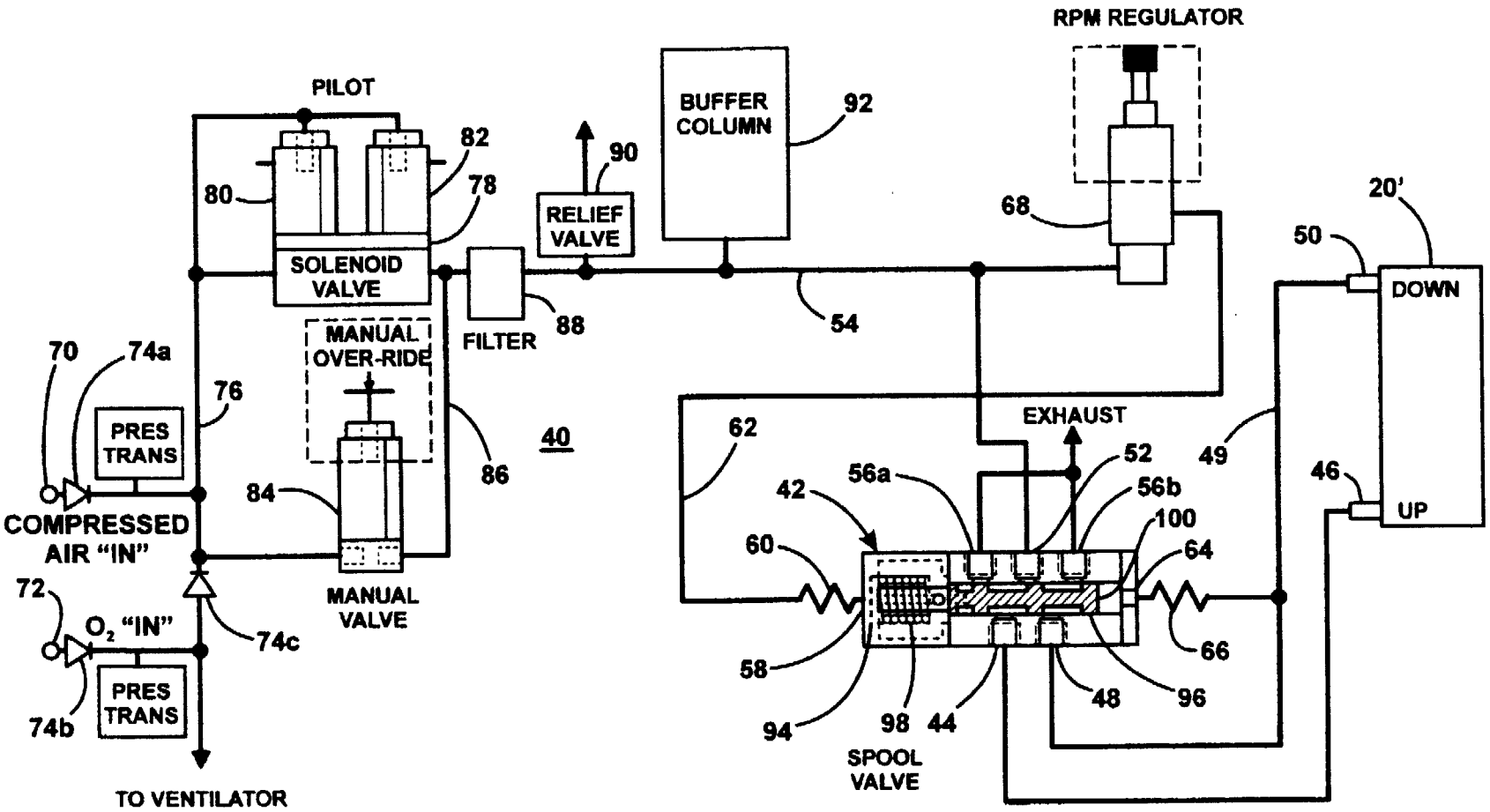
FIG. 10 is a schematic diagram of a pneumatic control system for a mechanical resuscitator useful with the invention.

In order to actively drive piston 18' in both an upward and downward direction, mechanical resuscitator 38 includes a pneumatic control system 40 (FIG. 10). In a preferred form, control system 40 includes a spool valve 42 having a first output port 44 connected with an input port 46 of cylinder 20', which, upon pressurization, drives the piston 18' in an upward direction, and a second output 48, which is connected by a line 49 with an input port 50 of cylinder 20', which, when upon pressurization, drives piston 18' in a downward direction. Spool valve 42 further includes an input port 52 connected with a high pressure line 54 and a pair of vent ports 56*a*, 56*b* connected with atmosphere. Spool valve 42 includes a first control port 58, connected through a control orifice 60 with a low pressure line 62, and a second control port 64, connected through an orifice 66 with line 49. Control port 58 is connected internally to a diaphragm 94, which operates the movement of a spool 96 against the force of a spring 98. Control port 64 is connected internally with a surface 100 of spool 96 positioned opposite of diaphragm 94. The force applied to diaphragm 94 from low pressure line 62 is resisted by both spring 98 and pressure supplied to control port 64 from supply line 49 acting against surface 100.

A pressure regulator 68 reduces pressure from high pressure line 54 to low pressure line 62 and regulates the pressure of line 62. High pressure line 54 is supplied from either a compressed air input 70 or an oxygen input 72 through appropriate check valves 74*a*, 74*b*, and 74*c*. Oxygen input 72 is primarily intended to supply oxygen to a ventilator (not shown), but provides an alternative source of compressed fluid for the operation of control system 40. The primary source of compressed fluid for control system 40 is from compressed air input 70 to a high pressure line 76. High pressure line 54 is selectively connected with high pressure line 76 by a latching dual-solenoid control valve 78 having a first solenoid 80, which latches valve 78 in an open condition upon the application of an electrical signal to solenoid 80, and a second solenoid 82, which latches valve 78 in a closed position upon the application of an electrical signal to solenoid 82. Electrical signals are supplied to control valve solenoids 80 and 82 from an electrical control (not shown). Electrically operated control valve 78 may be manually overridden by a manually operated override valve 84, which is provided to allow individual compression/decompression cycles to be manually activated in the absence of electrical control signals. An output 86 of valves 78 and 84 is filtered at 88 in order to supply high pressure line 54. High pressure line 54 is protected by a relief valve 90 and a surge tank 92.

In operation, control valve 78 is opened by the actuation of solenoid 80 when it is desired to apply CPR to patient 14.

As a result, high pressure is supplied to input port 52 and low pressure is supplied to control port 58. Initially, spool 96 is positioned to the left, as viewed in FIG. 10, which causes supply line 49 to be connected with vent port 56b, which is at atmospheric pressure. Accordingly, the low pressure applied to line 62 forces spool 96 to the right, as viewed in FIG. 10, which connects high pressure port 52 with output port 48 which pressurizes line 49 connected with input 50 of cylinder 20. This causes cylinder 20 to force piston 18' downwardly, as well as to apply a positive pressure to control port 64. Because the signal supplied to control ports 58 and 64 are through respective orifices 60 and 66, the pneumatic control signals are not instantaneously applied to the control ports but, rather, applied accordingly a particular time constant. Accordingly, a switching back of spool 96 takes place only when the force provided by spring 98 and the pressure at control 64 combine to equal the constant pressure applied to control port 58. Once this occurs, spool 96 returns back to the left position, as viewed in FIG. 10, connecting output port 44 with high pressure 52 and venting output port 48. This applies high pressure to input port 46 of cylinder 20', which forces piston 18' upwardly while venting line 49. At such time as the pressure on line 49 reduces sufficiently, the pressure at input port 58 overcomes the combined force of spring 98 and the pressure of control input 64 in order to shift spool 96 to the right, as viewed in FIG. 10, and thereby begin a new chest compression cycle.

An advantage of the preferred control technique disclosed in FIG. 10 is that it allows control over the rate of travel, during downward stroke, of piston 18' because of the unique combination of forces exerted on spool 96. In particular, the force applied from low pressure line 62 though orifice 60 upon diaphragm 94 being opposed by the combined forces of the pressure from line 49 through orifice 66 to input port 64 provides a controlled motion to piston 18'. The motion of piston 18' in a downward direction is a ramping motion with the slope of the ramp controlled by the respective values of orifices 60, 66, and spring force 98, as would be understood by the skilled artisan.

Figure 2:
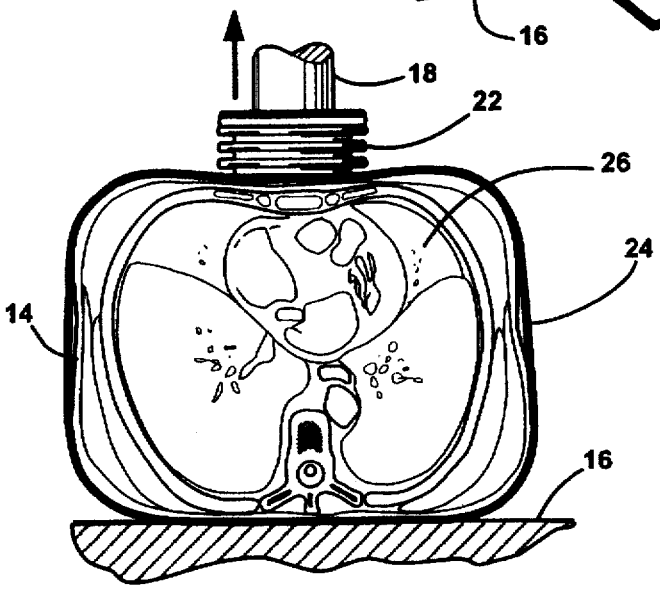
FIG. 2 is a sectional view taken along the lines II—II in FIG. 1 illustrating the decompression portion of a CPR compression/decompression cycle.

The features of the present invention may find application alone or in combination. The active reshaping of the chest through the use of a non-extensible annular collar around the patient's chest in combination with a piston which is actively driven upward, as well as downward, enhances the venous return of blood during decompression by reducing the intrathoracic pressure independently of the advantages of closely fitting a non-extensible annular collar to the patient's chest in order to restrain the circumference of the patient's thoracic cavity during chest compressions. Likewise, the use of a non-extensible annular collar closely fitted to a patient's chest, in order to restrain the circumference of the patient's thoracic cavity during chest compressions, serves to enhance both direct cardiac compression pumping and thoracic pumping even with a conventional resuscitator, which is capable of actively being driven in the downward direction with the compliance of the chest returning the piston to the upward direction. However, the benefits offered by these features, alone, may be enhanced by combining the features in a resuscitator that provides both cardio-thoracic pump CPR and active reshaping of the patient's chest. For example, closely fitting collars 24 (FIGS. 1–3) and 24' (FIGS. 4–6) are preferably joined with piston 18 and piston 18 is preferably actively driven in both the upward and downward strokes. This combination will increase arterial pressure during the compression portion of the cycle, in order to increase induced blood flow, and decrease thoracic cavity pressure during the decompression portion of the cycle, in order to increase venous return to the heart.

Changes and modifications in the specifically described embodiments can be carried out without departing from the principles of the invention, which is intended to be limited only by the scope of the appended claims, as interpreted according to the principles of patent law including the doctrine of equivalents.

The embodiments of the invention in which an exclusive property or privilege is claimed are defined as follows:

1. A method of performing cardio-pulmonary resuscitation, including:

restraining the circumference of a patient's thoracic cavity with a substantially non-extensible annular collar;

intermittently applying a compression force directed inwardly toward the patient from a location outwardly of the collar to the collar while the patient is supported posteriorly, wherein the collar transfers the external compression force through the collar to the patient's sternum in order to apply direct cardiac compression and wherein the collar translates the external compression force to a lateral restraint of the patient's chest in order to increase the intrathoracic cavity pressure of the patient; and actively reshaping the patient's thoracic cavity after each said applying in order to decrease intrathoracic cavity pressure of the patient, wherein said actively reshaping includes applying a compression force between opposite sides of the patient's chest, wherein said applying a compression force between opposite sides of the patient's chest includes applying an extension force to said annular collar in a direction anterior the patient's sternum.

2. A method of performing cardio-pulmonary resuscitation, including:

restraining the circumference of a patient's thoracic cavity with a substantially non-extensible annular collar;

intermittently applying a compression force directed inwardly toward the patient form a location outwardly of the collar to the collar while the patient is supported posteriorly, wherein the collar transfers the external compression force through the collar to the patient's sternum in order to apply direct cardiac compression and wherein the collar translates the external compression force to a lateral restraint of the patient's chest in order to increase the intrathoracic cavity pressure of the patient; and wherein said non-extensible collar includes an annular outer substantially non-extensible membrane and an annular interior extensible membrane positioned against the patient's chest defining an interior cavity in said collar between said membranes and a non-compressible fluid in said cavity, and wherein said applying a compression force includes compressing said cavity in order to compress the patient's thoracic cavity.

3. The method of claim 2 wherein said applying a compression force includes connecting said annular collar with a reciprocating piston that is actively driven in at least a posterior direction.

4. A method of performing cardio-pulmonary resuscitation, including:

at least partially surrounding the patient's thoracic cavity with a strap and connecting said strap to a piston which is reciprocated by an actuating device;

applying a compression force between a patient's sternum and spine by intermittently driving said piston with said actuating device toward the patient's sternum; and actively reshaping the patient's thoracic cavity after each said applying by actively driving said piston with said actuating device away from the patient's sternum in order to pull portions of the strap away from the patient and thereby decrease intrathoracic cavity pressure of the patient by applying a compression force between opposite sides of the patient's chest.

5. The method of claim 4 wherein said at least partially surrounding the patient's thoracic cavity with a strap includes restraining the circumference of the patient's thoracic cavity with a substantially non-extendable annular collar, wherein the collar translates the compression force to a lateral restraint of the patient's chest in order to increase the intrathoracic cavity pressure of the patient.

6. The method of claim 5 wherein said annular collar includes an endless member made from a non-extensible fabric.

7. The method in claim 5 wherein said annular collar includes an outer membrane made from a non-extensible fabric and an inner membrane thereby defining a cavity between said inner and outer membranes and further including a non-compressible fluid in said cavity.

8. The method in claim 7 wherein said non-compressible fluid is a hydraulic liquid.

9. A cardio-pulmonary resuscitation apparatus comprising:

a posterior support for a patient;

a reciprocating piston and an actuating device actively driving said piston alternatingly toward and away from said support, said actuating device substantially rigidly interconnected with said support, wherein said piston includes a pad at one end of said piston which alternatingly compresses and releases the sternum of a patient on said support; and a strap configured to substantially surround a patient's chest, said strap substantially rigidly joined directly to said piston pad wherein said pad and the portion of said strap attached to said pad move simultaneously and in unison in order to pull said portion of the strap away from a patient and thereby actively reshape the a patient's thoracic cavity when said piston is driven away from the support and thereby decrease intrathoracic cavity pressure of a patient.

10. The cardio-pulmonary resuscitation apparatus in claim 9 wherein said strap is a substantially non-extensible annular collar configured to closely surround a patient's chest in order to restrain the circumference of a patient's thoracic cavity when said piston is driven toward said support producing a compressive force which the collar transfers to a patient's sternum thereby applying direct cardiac compression and which collar translates to a lateral restraint of a patient's chest increasing the intrathoracic cavity pressure of a patient.

11. The apparatus in claim 2 wherein said annular collar includes an endless member made from a non-extensible fabric.

12. The apparatus in claim 10 wherein said annular collar includes an outer membrane made from a non-extensible fabric and an inner membrane, thereby defining a cavity between said inner and outer membranes, and further including a non-compressible fluid in said cavity.

13. The apparatus in claim 12 wherein said non-compressible fluid is a hydraulic liquid.

14. A method of performing cardio-pulmonary resuscitation, including:

providing a reciprocating piston which is actively driven by an actuating device;

restraining the circumference of a patient's thoracic cavity with a substantially non-extensible collar attached to said piston;

applying a concentrated compression force between a patient's sternum and spine by intermittently driving said piston toward the patient's sternum in order to apply direct cardiac compression, wherein said compression force is translated by said collar to laterally restrain the patient's chest in order to increase the patient's intrathoracic cavity pressure; and after said applying, actively reshaping the patient's thoracic cavity by imermittently driving said piston away from the patient's sternum and thereby decreasing intrathoracic cavity pressure of the patient;

wherein said non-extensible collar includes an annular outer substantially non-extensible membrane and an annular interior extensible membrane positioned against the patient's chest defining an interior cavity in said collar between said membranes and a non-compressible fluid in said cavity, and wherein said applying a concentrated compression force includes compressing said cavity in order to compress the patient's thoracic cavity.

* * * * *

UNITED STATES PATENT AND TRADEMARK OFFICE

CERTIFICATE OF CORRECTION

PATENT NO. : 5,743,864
DATED : April 28, 1998
INVENTOR(S) : R. Mitchell Baldwin, II It is certified that error appears in the above-identified patent and that said Letters Patent is hereby corrected as shown below:

Column 4,
Line 9, “arrows A’” should be -- arrows A --

Column 5,
Line 9, “cylinder 20” should be -- cylinder 20’ -- in both occurrences Column 6,
Line 37, “form” should be -- from --

Column 7,
Line 41, delete “the” after “reshape”

Column 8,
Line 8, “Claim 2” should be -- Claim 10 --

Signed and Sealed this

Fifteenth Day of April, 2003

JAMES E. ROGAN
*Director of the United States Patent and Trademark Office*